US005797140A

United States Patent [19]

Davis et al.

[11] Patent Number: 5,797,140

[45] Date of Patent: Aug. 25, 1998

[54] BALLISTIC RESISTANT GARMENT ASSEMBLY AND METHOD OF USING THE SAME

[75] Inventors: Richard Clinton Davis, Travers City; Gail Marie St. Amour, Eastport, both of Mich.

[73] Assignee: Second Chance Body Armor, Inc., Central Lake, Mich.

[21] Appl. No.: 323,854

[22] Filed: Oct. 17, 1994

Related U.S. Application Data

[63] Continuation of Ser. No. 981,250, Nov. 25, 1992, abandoned.

[51] Int. Cl.[6] ..... F41H 1/02

[52] U.S. Cl. ..... 2/2.5

[58] Field of Search ..... 2/2.5, 2, 102, 108, 2/92, 94, DIG. 6; 89/36.05; 441/88, 90, 92, 93, 106, 108, 111–113, 116, 117, 123, 125

[56] References Cited

U.S. PATENT DOCUMENTS

| | | | |
|---|---|---|---|
| 3,484,974 | 12/1969 | Culmone | 2/115 |
| 4,578,821 | 4/1986 | Zufle | 2/2.5 |
| 4,969,214 | 11/1990 | Cohen | 2/246 |
| 5,060,314 | 10/1991 | Lewis | 441/112 X |
| 5,073,985 | 12/1991 | Stone et al. | 2/2.5 |

FOREIGN PATENT DOCUMENTS

| | | | |
|---|---|---|---|
| 1030394 | 3/1953 | France | 224/151 |
| 721254 | 1/1955 | United Kingdom | 441/92 |

*Primary Examiner*—Paul C. Lewis
*Attorney, Agent, or Firm*—Potthast & Ring

[57] ABSTRACT

A ballistic resistant garment carrying assembly having a foldable ballistic panel movable from a nondeployed position from a pouch to a deployed position in which the panel extends from the pouch. The pouch being mountable to the body of a wearer. The foldable ballistic resistant panel is suspendable from a wearer's neck when in a deployed position. A ballistic resistant gun holster adjustably mounted onto the ballistic resistant panel. A holder for adjustably securing a gun handle to a ballistic resistant panel. An authority identification sign carried on the ballistic resistant panel. An ammunition pouch mounted onto the ballistic panel. A ballistic resistant crotch pad moveable from a mounted overlying position with another ballistic resistant panel that is secured to a mid-section of a person's body to an extended position below the ballistic resistant panel. A pouch assembly having an inner and outer belt section respectively secured to an inner and outer panel of the pouch in which the inner belt section is extendable from a length shorter than the outer belt section to at least the length of the outer belt section when secured to a body of a wearer closing the pouch.

25 Claims, 6 Drawing Sheets

BALLISTIC RESISTANT GARMENT ASSEMBLY AND METHOD OF USING THE SAME

This application is a continuation of application Ser. No. 07/981,250, filed Nov. 25, 1992, now abandoned.

BACKGROUND OF THE INVENTION

1. Field of the Invention

The present invention relates to a ballistic resistant garment assembly and method to use the same, and more particularly, a ballistic resistant garment assembly having a flexible ballistic resistant panel deployable from a garment pouch, having identification signage; adjustable holster; ballistic resistant holster; gun handle securement members; ammunition holders; pouch belt members; deployable ballistic crotch pad; and securement from the user's neck.

2. Description of the Related Art Including Information Disclosed Under 37 CFR 1.97-1.99

Various ballistic resistant garment assemblies are known. However, these assemblies as discussed below do not have the inventive features'of the present invention.

In U.S. Pat. No. 1,277,706 issued Sep. 3, 1918, to Dorfman it discloses a series of plates. However, these plates are not foldable but rather are telescopic with one another. This telescopic series of plates do not provide adequate protective covering, since the telescopic construction has each successive plate reducing in width as the entire shield extends upwardly along the wearer's torso thereby providing less protection. The telescopic construction does not have the capability to conform to various contours of different wearers' bodies. In deploying the telescopic plates the wearer must apply a precise direction of lifting force in order to avoid jamming of the connectors between the series of plates. Similarly, the telescopic construction restricts the wearer to a particular extending alignment of the series of plates. Ballistically resistant weak locations are provided in Dorfman by the telescopic connectors enhancing the danger to a wearer. Further, the speed to cover the torso is decreased because each discrete panel of the shield in Dorfman must be fully extended before the adjacent panel begins extending. In U.S. Pat. No. 3,855,632 issued Dec. 24, 1974, to Davis the protective shield is not deployable. The shield is fully extended on the wearer at all times and over time can be warmer and more uncomfortable than a nondeployed vest. Further, this shield is restricted to its predetermined protective area and does not provide the flexibility of moving the shield to or from a nondeployed position or any degree of the same while mounted to a wearer's body. U.S. Pat. No. 4,413,357 issued Nov. 8, 1983 to Sacks and U.S. Pat. No. 4,497,069 issued Feb. 5, 1985, to Braunhut, both have shields that are not folded when in a nondeployed position thereby providing the disadvantage of not making the shield more compact and versatile. U.S. Pat. No. 4,483,469 issued Nov. 20, 1984, to Arisland and U.S. Pat. No. 4,637,076 issued Jan. 20, 1987 to Tartt et al. provide carrying bags which are convertible to vests, however, neither provide the advantage of ballistic resistant protection as does the present invention.

Unfortunately, many times even highly experienced firearm users have made the mistake of accidentally discharging hand guns when attempting to quickly remove or place the gun into a holster. The accidental firing or discharge of the weapon is extremely dangerous and can even result in fatal injury to the user of the firearm or another individual nearby. U.S. Pat. No. 3,347,299 issued Oct. 17, 1967, to Alexander; U.S. Pat. No. 4,258,871 issued Mar. 31, 1981, to McMahon; U.S. Pat. No. 4,750,655 issued Jun. 14, 1988, to Barry; U.S. Pat. No. 4,718,585 issued Jan. 12, 1988, to Atkins, Sr.; and U.S. Pat. No. 4,966,320 issued Oct. 30, 1990 to DeSantis et al. all are known to provide various hand gun holster assemblies. However, none of these patents provide the safety advantage of having a ballistic resistant portion in the muzzle carrying section of the holster to block an accidental discharge of the gun while in the holster thereby reducing or even eliminating the danger to the user and others within firing range.

It is desired in a hand gun carrying assembly to have a gun muzzle receptacle which can be versatilely mounted and adjusted at many different locations and at many different angles to give the user the benefit of placing the gun muzzle receptacle holding a gun at a convenient and comfortable location to the user. U.S. Pat. No. 4,966,320 to DeSantis et al. provides a gun holster which is reversibly mounted on a panel for right and left hand users. DeSantis et al. disadvantageously provides only limited positioning of the gun holster since the holster is secured within a pouch by a permanently attached strap to the pouch body thereby restricting the placement of the holster only at regions and at angles in which the strap is capable of carrying the holster.

U.S. Pat. No. 3,347,299 issued to Alexander provides a gun carrying panel having a holster which is insertable into a handbag. U.S. Pat. No. 4,480,776 issued on Nov. 6, 1984 to Atkins, Sr. discloses a gun holster having tabs which secure together at a hammer spur location of a hand gun to prevent forcible removal of the hand gun from the holster. U.S. Pat. No. 4,750,655 issued to Barry also has a releasable hammer strap which secures around a hammer portion of a hand gun. Disadvantageously, in each of these patents the hand gun can only be positioned within the holster in a way limited by the hammer straps and by the shape of the holster. None of these patents provide a member which is carried by a gun handle to easily secure and position the hand gun at locations so the gun is comfortably accessible and removable from a gun holster. It is therefore desired to provide a gun handle holder capable of positioning a gun handle at various angles and locations within a gun carrying assembly so a user can selectively position and secure the gun to meet his particular needs.

Authority figures such as law enforcement and security personnel are often times required to identify themselves when in the process of apprehending a suspect. However, when such authority personnel are in undercover situations, especially those involving the apprehension of a suspect who is armed, it is typically impractical to reach for and properly show their identification. When in pursuit of an armed individual, it is desired that law enforcement personnel wear ballistic resistant protection. Therefore it is desirable for a ballistic resistant garment to carry an authority identification sign which is not always visible for undercover situations but is moveable to identify an authority figure by making the sign visible when a ballistic resistant panel is extended. Ballistic resistant garments are known in U.S. Pat. No. 3,557,384, issued January 26, 1971, to Barron et al; U.S. Pat. No. 3,855,632 issued Dec. 24, 1974, to Davis; and U.S. Pat. No. 4,079,464 issued Mar. 21, 1978, to Roggin. However, none of these garments utilize any authority identification in association with the ballistic resistant garment.

Often uses of ballistic resistant garments are in the law enforcement or security profession, in which, it is desired or even required that a fire arm with extra ammunition be carried while on duty. Therefore, the need for a ballistic resistant garment which is also capable of comfortably carrying and easily storing ammunition has been created. U.S. Pat. No. 3,347,299, issued Oct. 17, 1967, to Alexander provides an ammunition case secured to a purse. However, it does not produce the advantage of having an ammunition pouch mounted to a ballistic resistant panel to carry ammunition on a ballistic resistant garment assembly.

Many ballistic resistant garments have had lower torso or crotch ballistic resistant sections. These crotch ballistic resistant sections in U.S. Pat. No. 4,079,464, issued Mar. 21, 1978, to Roggin; U.S. Pat. No. 4,413,357, issued Nov. 8, 1983, to Sacks; and U.S. Pat. No. 5,060,314, issued Oct. 29, 1991, to Lewis are all in a deployed or protective position and do not take on a nondeployed position. As a result, the ballistic resistant crotch pads are not concealed and are not removed to prevent inhibiting movement of the wearer. As a result, such garments are not versatile to be able to move such pads from a use to nonuse position and vice versa. In U.S. Pat. No. 4,497,069, issued Feb. 5, 1985, to Braunhut, the ballistic resistant crotch pad is releasably secured to the ballistic resistant garment, however, the pad must be removed completely or be in a deployed position only. There is no nondeployed position where the crotch pad is still mounted to a wearer's body. As a result, the crotch pad when needed must be inconveniently mounted to and extended from a ballistic resistant garment.

Law enforcement personnel often require ballistic resistant garments and, moreover, would need a quick and easy way in which to deploy the ballistic garment. Numerous ballistic resistant garments are known, however, none provide a member secured to the upper portion of the ballistic garment for quick and accurate deployment of the garment. Further, no member is provided which will suspend a ballistic resistant garment over a wearer's neck.

It is often necessary to be able to have a pouch carrying assembly that will contract its opening when secured to a wearer's body and provides quick access through the contracted opening while the pouch is being worn. In U.S. Pat. No. 4,966,320, issued Oct. 30, 1990, to DeSantis et al. the pouch assembly is worn with a single belt, however, the pouch assembly is secured in a closed position with hook/loop releasably securable fasteners. As a result, the pouch assembly must be opened by grasping at least a portion of the pouch assembly and pulling apart the hook/loop releasable securable fasteners before the pouch is opened. This process requires more movement to access the interior portion of the pouch and takes more time.

SUMMARY OF THE INVENTION

It is therefore the principal object of the present invention to provide a ballistic resistant garment carrying assembly comprising a foldable ballistic resistant panel in which the panel is mountable to the body of a wearer and where the panel is movable from a nondeployed position to a deployed position.

The object of the present invention is achieved in part by provision of a ballistic resistant garment carrying assembly with a ballistic resistant panel and a pouch for carrying the ballistic resistant panel. The pouch is securable to a body of a wearer and the panel is movable from a nondeployed position within the pouch to a deployed position.

A further object of the invention is achieved by providing a ballistic resistant gun holster with a receptacle having sidewalls for holding the body of a gun muzzle. A ballistic resistant wall is secured to at least a portion of a sidewall of the receptacle to block a discharge from the muzzle of the gun.

A further object of the invention is achieved by providing a receptacle with sidewalls for holding the body of a gun muzzle in which at least a portion of the sidewalls is comprised of a ballistic resistant material and securing means of the receptacle to the wearer is associated with the receptacle.

Another object of the invention includes an adjustable gun holster having a gun muzzle receptacle, a pair of releasable universal mating connectors, a receptacle carrying panel, one of the pair of the releasable universal mating connectors is mounted to the receptacle carrying panel. Another releasable universal mating connector is mounted to a side of the receptacle for releasable universal connection with one of the pair of the releasable universal mating connectors mounted to the panel to position the receptacle in a desired position relative to the receptacle carrying panel.

Another object of the present invention is achieved by a releasably securable and movable gun handle holder utilizing a gun carrying panel, a pair of releasable universal mating connectors, a securing member carried by a gun handle and means for mounting one of the pair of the releasable universal mating connectors to the gun carrying panel. The other releasable universal mating connector is mounted to the member carried by the gun handle for releasable universal connection with one of the pair of releasable universal mating connectors mounted to the panel to secure and position the gun in a desired position relative to the carrying panel.

Another object of the present invention is achieved by providing a ballistic resistant garment with a first ballistic resistant panel portion, a second ballistic resistant panel portion connected to the first panel, an authority identification sign carried on the second ballistic panel portion and means for moving the second ballistic resistant panel portion in relation to the first ballistic resistant panel portion from a nondeployed position in which the sign is not visible to a deployed position in which the sign is visible.

Another object of the present invention is achieved by providing a ballistic resistant garment comprising a ballistic resistant panel and an ammunition pouch which is mounted on the ballistic resistant panel.

A further object of the present invention is achieved by providing a ballistic resistant garment comprising a first ballistic resistant panel which is mounted over at least a portion of a mid-section of a person's body. A second ballistic resistant panel is mounted to the first panel for movement between a nondeployed position in which the first and second panel are in overlying relationship with each other to a deployed position in which the second panel extends below the first panel.

Still another object of the present invention is achieved by providing a ballistic resistant garment comprising a foldable ballistic resistant panel having a bottom portion and a top portion which is moveable from a folded position to an extended position. By grasping a portion secured to the top portion of the bullet resistant panel, the panel is deployable from the folded position to the extended position.

Yet a further object of the present invention is achieved by providing a ballistic resistant garment comprising a ballistic resistant panel which has a member secured to the panel to suspend the panel from a neck of a wearer.

A further object of the present invention is achieved by providing a pouch carrying assembly having inside and outside panels adjacent to an opening of the pouch comprising an inner belt section stretchable between a first and second length which is longer than the first length, an outer belt section having a length substantially equal to the second length, and the opposite ends of the inner and outer belt sections are secured together. The inner belt section is secured to the inside panel of the pouch adjacent the pouch opening and the outer belt section is secured to the outside panel of the pouch adjacent to the pouch opening.

A further object of the present invention is achieved by providing a method of deploying a ballistic resistant panel carried by a garment pouch by moving the ballistic resistant panel from the pouch to an extended position outside of the pouch utilizing the steps of grasping the ballistic resistant panel from the garment pouch and lifting the ballistic resistant panel to the extended position.

A further object of the present invention is also achieved by providing a method for adjusting and securing a gun holster having a muzzle receptacle to a receptacle carrying panel. This is accomplished by securing a universal releasable mating connector to the receptacle carrying panel, securing a universal releasable mating connector to a side of the muzzle receptacle and releasably securing the universal mating connector of the muzzle receptacle to the universal mating connector of the receptacle carrying panel.

A further object of the invention is achieved by providing a method for attaching and displaying an authority identification sign to a ballistic resistant garment having a first and a second ballistic resistant panel portion in which the sign is carried by the second panel portion. The first ballistic resistant panel portion is mounted in relation to the second ballistic resistant panel portion for movement between a nondeployed position in which the sign is not visible and a deployed position in which the sign is visible. The object is accomplished by placing the first and second ballistic resistant panel portions in a nondeployed position and moving the first and second ballistic resistant panel portions to a deployed position displaying the sign.

Another object of the present invention is to provide a method for deploying a ballistic resistant panel carried by a garment pouch by moving the ballistic resistant panel from the pouch to an extended position outside of the pouch. This method includes grasping the ballistic resistant panel from the garment pouch and lifting the ballistic resistant panel to the extended position.

Another object of the present invention is achieved by providing a method for adjusting and securing a gun holster having a muzzle receptacle to a receptacle carrying panel. This method includes securing a universal releasable mating connector to the receptacle carrying panel and securing a universal releasable mating connector to a side of the muzzle receptacle. In addition, releasably securing the universal mating connector of the muzzle receptacle to the universal mating connector of the receptacle carrying panel.

Another object of the present invention is achieved by providing a method for displaying an authority identification sign of a ballistic resistant garment having a first and second ballistic resistant panel portions in which the sign is carried by the second panel portion and in which the first ballistic resistant panel portion is mounted in relation to the second ballistic resistant panel portion for movement between a nondeployed position in which the sign is not visible and a deployed position in which the sign is visible. This method includes placing the first and second ballistic resistant panel portions in a nondeployed position and moving the first and second ballistic resistant panel portions into a deployed position displaying the sign.

Still another object of the present invention is achieved by providing a method for adjustably securing a gun handle to a gun carrying panel. A member is carried by the gun handle and a pair of releasable universal mating connectors are mounted to the member and the gun carrying panel. The method is achieved by securing the member to the gun handle and releasably securing the releasable mating pair of connectors to one another then securing the gun handle to the gun carrying panel in the desired position.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENTS

Figure 1:
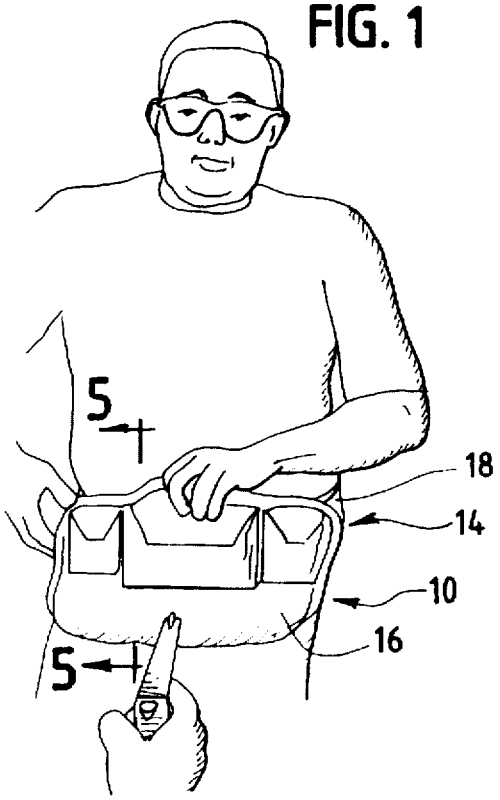
FIG. 1 is a perspective view of the ballistic resistant garment carrying assembly as secured to the body of a wearer.
Figure 2:
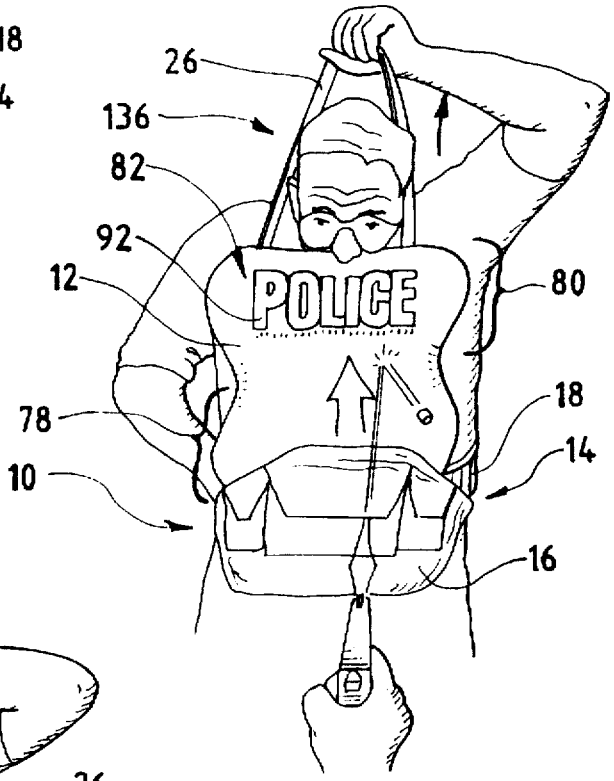
FIG. 2 is a perspective view of the ballistic resistant garment carrying assembly of FIG. 1 in which a ballistic resistant panel is deployed.
Figure 3:
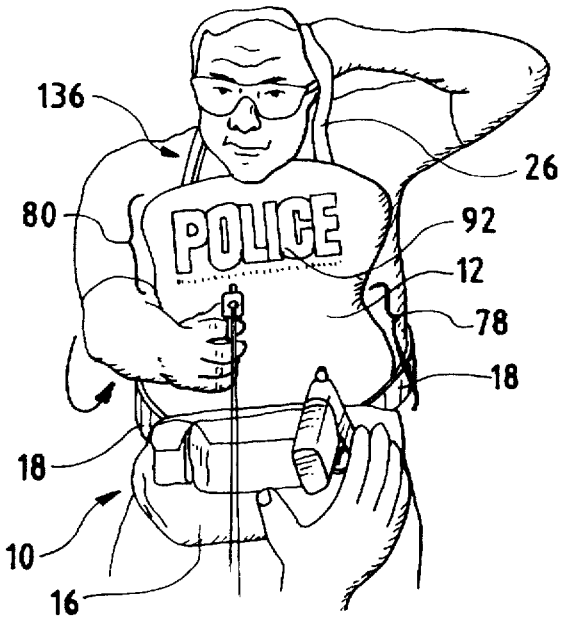
FIG. 3 is a perspective view of the ballistic resistant garment carrying assembly of FIG. 1 in which a ballistic resistant panel is suspended from the neck of a wearer.
Figure 5:
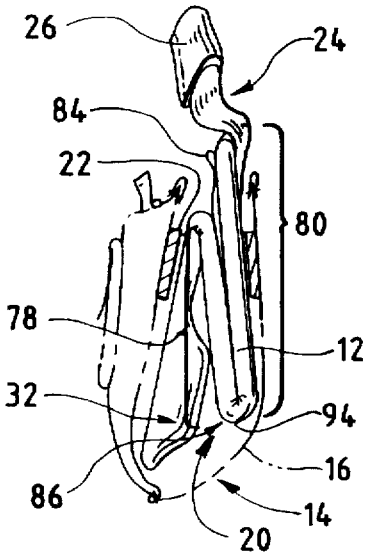
FIG. 5 is a cross sectional view of the ballistic resistant garment assembly of FIG. 1 as shown along line 5—5.

Referring to the accompanying drawing figures, ballistic resistant garment carrying assembly 10 is shown in FIGS. 1–3, as worn by a wearer. The bullet resistant garment carrying assembly 10 includes foldable bullet resistant panel 12 for overlying a portion of a torso of a wearer which is made of a ballistic resistant material such as soft bodied armors made of Kevlar®, manufactured by DuPont Company of Wilmington, Del., or other commonly known soft bodied armor materials commonly known in the art. Panel 12 could also be constructed having hard ballistic resistant panels incorporated therein made of steel, ceramic and other commonly known materials in the art. As can be seen in FIG. 5, panel 12 is foldable making panel 12 more compact in a nondeployed position. Folding panel 12 can also include rolling the panel up, hinging or creasing panel 12 in any other commonly known manners to make the nondeployed panel 12 more compact.

Panel 12 is secured to the wearer's body by mounting means 14 which includes a means for concealing 16 ballistic resistant panel 12 or pouch 16 which carries panel 12 in a folded and nondeployed position and includes garment or belt 18 which is secured to pouch 16 and in turn secures pouch 16 to the wearer's body. Panel 12 could be concealed also by other commonly known manners which would also include rolling up panel 12 in a nondeployed position and securing the rolled up panel 12 to the wearer's body with belt 18. Pouch 16 is often constructed of nylon or similar types of materials that are strong, water repellant and are easily cleaned. Similarly, panel 12 is often covered with a similar type of material. Additionally, garment 18 could include securing concealing means or pouch 16 to the wearer by securing the same directly to a shirt, jacket, trousers or other garments that can be worn by the wearer.

Figure 6:
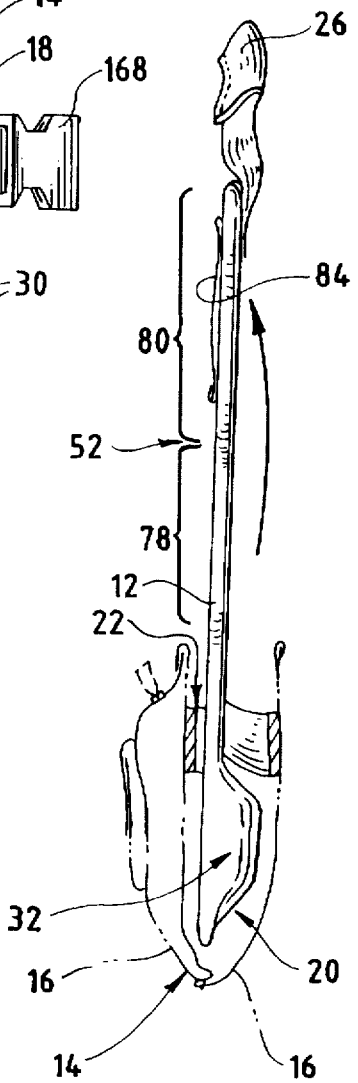
FIG. 6 is a cross sectional view of the ballistic resistant garment assembly of FIG. 4 as shown along line 6—6.

Typically, the bullet resistant panel 12 can be connected to pouch 16, as shown in FIGS. 5–6, by having the lower portion of panel 12 connected to inner portion 20 of pouch 16 thereby preventing panel 12 from exiting pouch 16 when panel 12 is quickly deployed, as seen in FIGS. 1–3. Panel 12 can be releasably connected to inner portion 20 of pouch 16 by many commonly known releasable connectors, snaps, buttons, clips, etc. or by a pair of mating hook and loop fasteners 22, such as Velcro® manufactured by Velcro U.S.A., Incorporated of Massachusetts, N.H., and Norcross, Ga., typically at a location as shown in FIGS. 5 and 6. Fasteners 22 have one of pair 22 attached to panel 12 and the other of pair 22 attached to inner portion 20 of pouch 16 to provide a desired releasable connection between panel 12 and pouch 16. Panel 12 can be connected to numerous portions of pouch 16 to accomplish concealing panel 12 when panel 12 is in a nondeployed position. An example is shown in FIG. 5. It is in many instances desirable to secure the lower portion of panel 12 from exiting or moving above pouch 16 when panel 12 is deployed, as seen in FIGS. 2–3 and thereby optimize the protection coverage of the wearer.

Figures 11A, 11B:
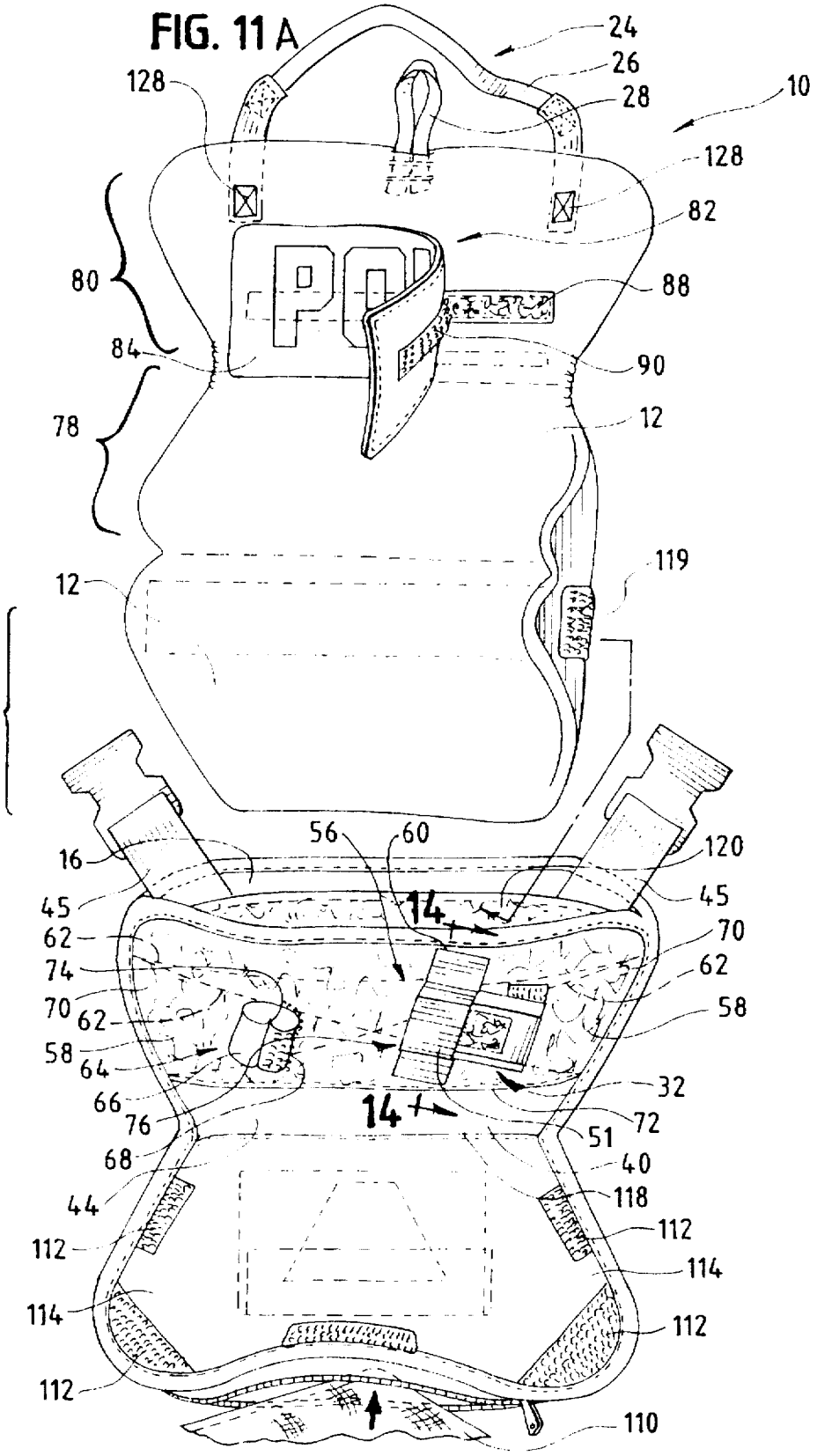
FIG. 11 is a front view of another embodiment of the ballistic resistant garment carrying assembly in which the ballistic resistant panel is removed from the pouch assembly and a crotch ballistic resistant pad partially assembled depends therefrom.

Means for moving 24 panel 12 from a nondeployed position to a deployed position is seen in FIGS. 5–6. Means for moving 24 can include strap 26 which can form a loop with the top portion of panel 12 as seen in FIGS. 2–7 and 11 and in a smaller form, loop 28 as seen in FIG. 11. Means for moving 24 can also include a portion of panel 12 itself. This typically would be the top portion or even the top end portion of panel 12. This top or top end portion is unsecured to pouch 16 and is positioned near the opening of the pouch 16 as can be seen in FIG. 5. This positioning permits the wearer to quickly grab the free top portion of panel 12 or even strap 24 or strap 28, as seen in FIG. 11, that could be secured to the top portion or upper end portion of panel 12 and be also positioned at the opening of pouch 16, which provides quick deployment of panel 12 as seen in FIGS. 1–3. The wearer could grab strap 26 or a portion of panel 12 itself and pull thereby deploying panel 12 to wearer's desired deployed position. In the deployed position, panel 12, as seen in FIGS. 2, 3, 4, 7 and 11, has an upper and lower portions which are wider in a transverse direction relative to the direction in which the torso of the wearer extends than the central portion of panel 12. This narrower portion as can be more clearly seen in FIGS. 2 and 3 provide an area where the panel does not inhibit the movement of the wearer's arm and hand that is drawing his gun. The wearer's arm and hand travel close to the body of the wearer in a proximate location between the chest and waist of the wearer with the drawing of the wearer's weapon. The narrower region eliminates panel 12 from being moved out from the torso of the body and thereby reduce the effectiveness of panel 12 and at the same time does not restrict the needed quick accurate movement of the wearer's weapon.

Ballistic resistant garment assembly 10 can also be constructed wherein ballistic resistant panel 12 is not folded but rather is held in pouch 16 in a flat position; in a bent or curved repose; or even in connected panel sections stacked to partially overlap much as a venetian blind or in numerous like ways. Panel 12, as described above, could be carried by pouch 16; secured to the body of the wearer; and have means of deploying panel 12 from a nondeployed to a deployed position.

Figure 4:
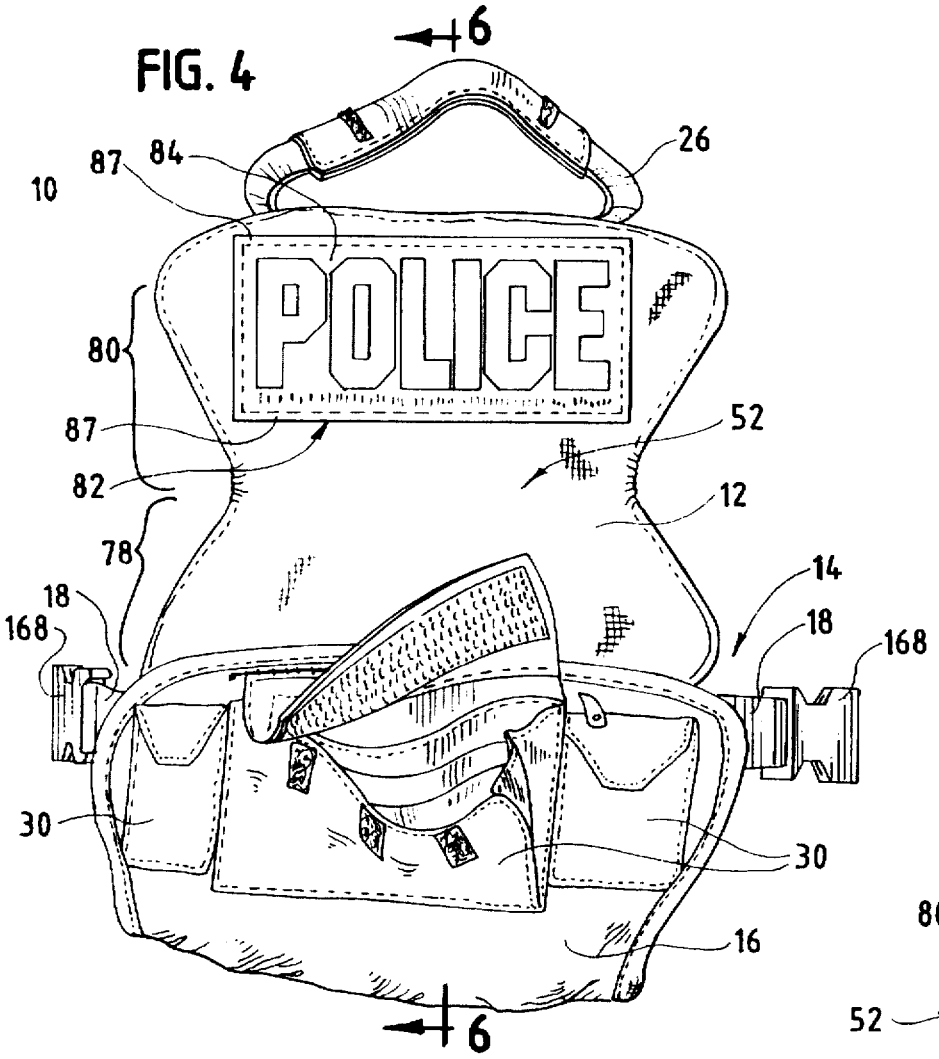
FIG. 4 is a perspective view of the ballistic resistant garment carrying assembly showing partially open frontal pockets.

Often times it is desirable to have pouch 16 take on the appearance of very commonly known sports waist pouches in providing concealment for ballistic resistant panel 12. In addition, pouch 16 will have pockets 30, as seen in FIG. 4, disposed on its exterior for carrying money, credit cards, change, wallets, keys and other items of convenience, thereby providing easy storage, access and further concealment of panel 12.

Figure 10:
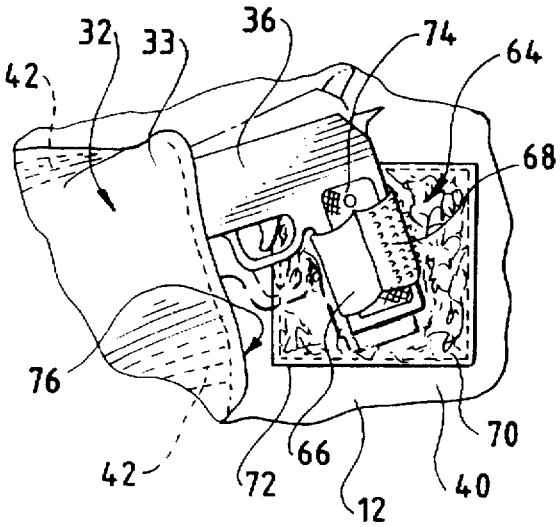
FIG. 10 is a partial perspective view of the ballistic resistant holster and gun handle securement assembly of FIG. 7.
Figure 13:
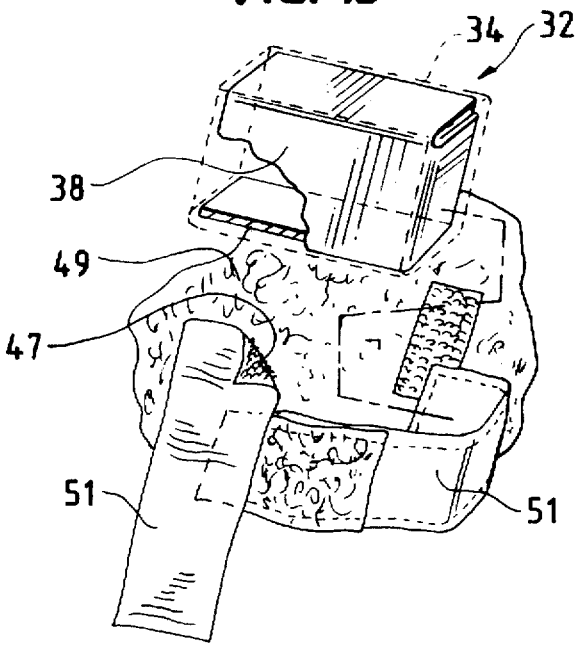
FIG. 13 is a partial view of the pouch assembly of FIG. 11 showing another embodiment of a ballistic resistant holster in an exploded view.
Figure 14:
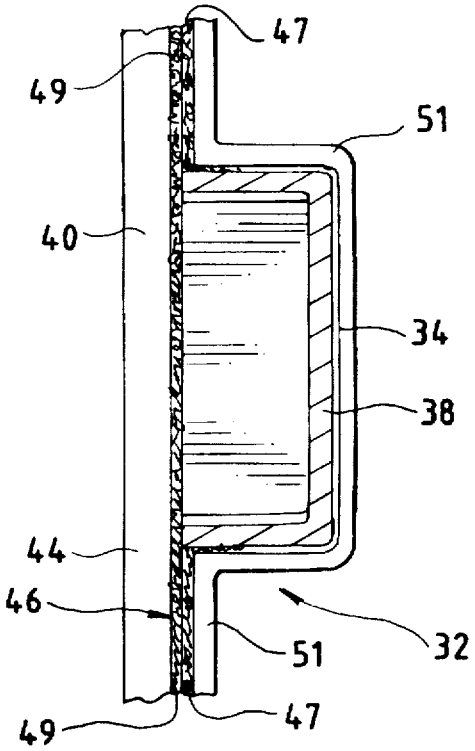
FIG. 14 is a cross sectional view of the ballistic resistant holster in FIG. 11 as shown along line 14—14.

Ballistic resistant gun holster 32 as shown in FIGS. 11, 13 and 14 comprises a receptacle having sidewalls 34 for holding the body of a gun muzzle 36 as seen for an example in FIG. 10. Ballistic resistant wall 38 is secured to at least a portion of a sidewall 34 as seen in FIGS. 13 and 14 to block a discharge from gun muzzle 36, when gun muzzle 36 is in alignment with the interior of the receptacle. Ballistic resistant wall 38 is comprised of a metallic member, ceramic, flexible materials such as Kevlar® or other commonly known ballistic resistant materials and can be made to provide ballistic resistance to as much of the receptacle as desired. Such wall 38 will contour at least a portion of sidewall 34 of the receptacle as seen in FIG. 14. Ballistic resistant gun holster 32 can be easily mounted to a panel for carrying a holster 40. Such panel for carrying a holster 40 contemplates a wide range of objects that may have a gun secured to it such as for example compartments of furniture and vehicles; accessories to garments such as purses, briefcases, gym bags; garments including garments normally worn by individuals to ballistic resistant garments; and the like. Numerous locations would be suitable for a panel for carrying a holster 40. In FIGS. 11, 13 and 14, mounting the receptacle to panel for carrying holster 40 is shown. The receptacle is releasably mounted to panel 40. As seen in FIG. 14, sidewall 44 of pouch 16, has a mating pair of hook and loop fasteners 46 such as Velcro® or the like, in which one of pair of fasteners 47 is secured to the receptacle with securement straps 51 and the other 49 to said sidewall 44.

Figure 7A:
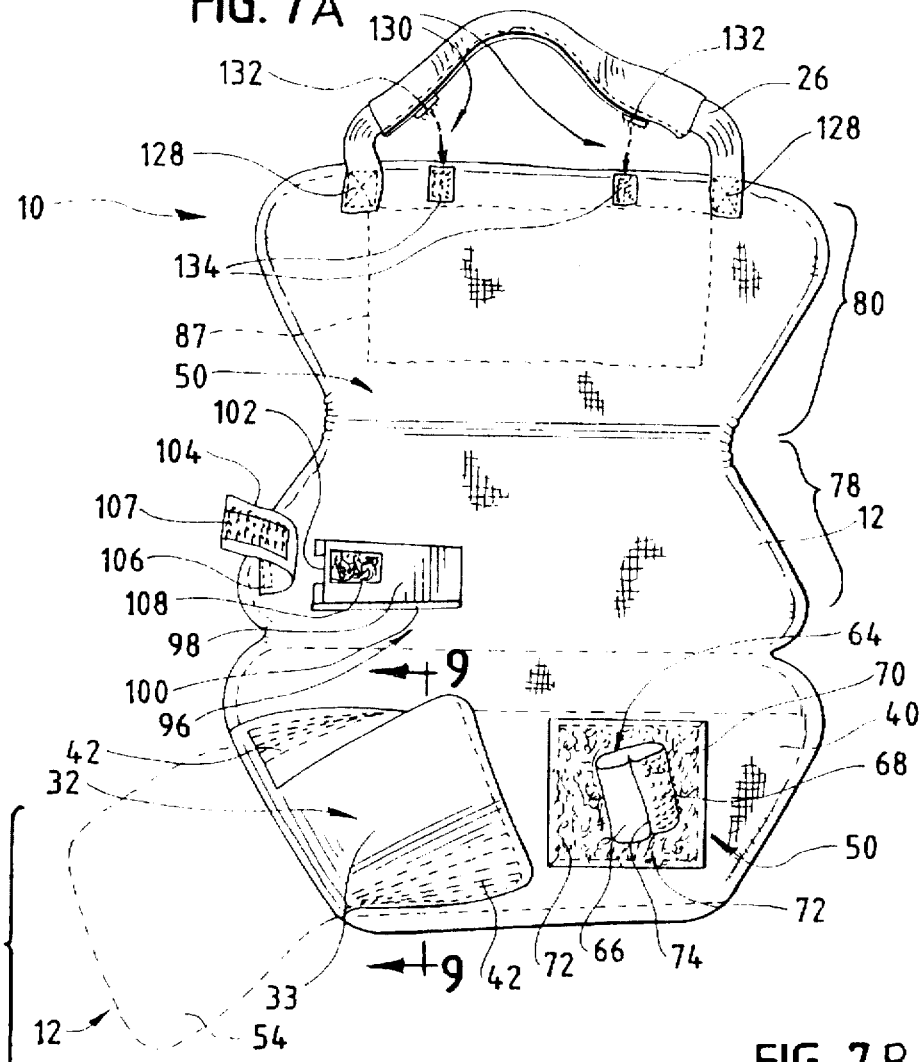
FIG. 7 is a back view of a ballistic resistant garment carrying assembly in which a ballistic resistant panel is removed from a pouch assembly.
Figure 7B:
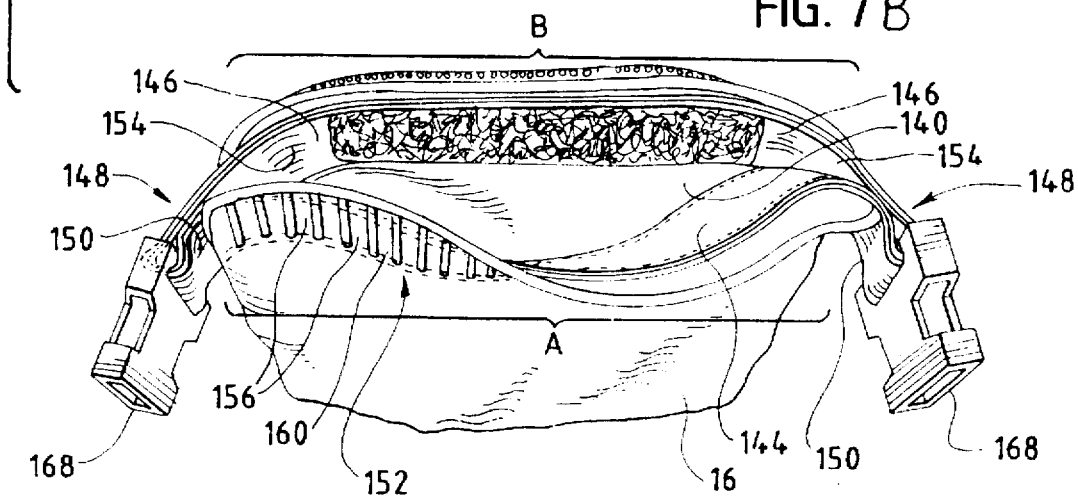
Figure 9:
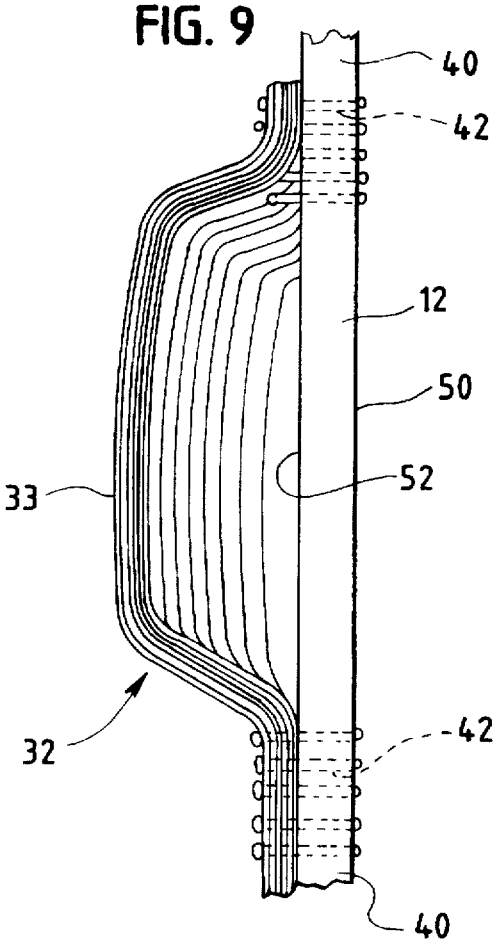
FIG. 9 is a cross sectional view of the ballistic resistant gun holster of FIG. 7 as shown along line 9—9.

Another embodiment of ballistic resistant gun holster 32 is shown in FIGS. 7, 9 and 10. This holster comprises a receptacle 33 for holding the body of a gun muzzle in which at least a portion of the sidewall is constructed of a flexible ballistic resistant material such as Kevlar® or other commonly known ballistic resistant material of this type or other well known ballistic resistant materials such as metal, ceramic, etc.

As shown in FIGS. 7 and 9, ballistic resistant gun holster 32 receptacle 33 can be mounted to gun carrying holster panel 40, in this case ballistic resistant panel 12, by stitching 42 portions of the receptacle to panel 12. Should the ballistic resistant holster be of a harder material such as metal, ceramic, etc., other conventional securing means could be used such as seen in FIG. 14.

Ballistic resistant garment or panel 12 has an inner side 50, as seen as FIG. 7, which is worn closest to the wearer's body and an outer side 52 as shown in FIGS. 4 and 6. In FIGS. 6 and 7, gun holster 32 is mounted to the inner side 50 of ballistic resistant garment or panel 12 although this may be the desired side to mount holster 32, holster 32 can be mounted to outer side 52 as well.

As seen in FIG. 7, gun holster 32 can be comprised of ballistic resistant material. Gun holster 32 is formed of the ballistic resistant material of ballistic resistant panel 12, as seen drawn in phantom, extension 54 of panel 12 is formed prior to holster 32 being formed. Extension 54 is then folded and connected to ballistic resistant panel 12 forming gun holster 32. Gun holster 32 is mounted to ballistic resistant panel 12 with stitching 42 or other common means of mounting. Other common means for mounting include a releasable securement such as utilizing a mating pair of hook and loop fasteners in which one of the pair of fasteners is secured to ballistic resistant panel 12 and the other of the pair is secured to the holster 32. This can be accomplished by utilizing a well known fastener such as Velcro®, or by utilizing other commonly known releasable securements such as buttons, clips, and the like, or even gluing, etc.

Adjustable gun holster 56 has gun muzzle receptacle 32 and receptacle carrying panel or sidewall 44 of pouch 16 as shown in FIG. 11 having means to secure pouch 16 to the body of a wearer such as belt 45 or any other garment or the like. As previously discussed, receptacle carrying panel can be any panel which would support a gun holster which contemplates a wide range of objects that may have a gun secured to it such as, for example, compartments of furniture and vehicles; accessories to garments such as purses, briefcases, gym bags, etc.; garments, including garments normally worn by individuals to ballistic resistant garments; and the like. Further adjustable gun holster 56 includes a pair of releasable universal mating connectors 58 and 60 in which each is respectively associated with receptacle carrying panel of sidewall 44 and receptacle or holster 32. Further means for mounting connector 58 to sidewall 44 include stitching 62 or gluing or the like. Similarly, connector 60 can be secured to receptacle or holster 32 by glue or other common connectors. Universal mating connectors 58 and 60 can be what is commonly known as mating hook and loop fasteners or Velcro® and the like.

Gun muzzle receptacle or holster 32 as seen in FIG. 11 can include, as previously discussed, wall member 38 formed of a ballistic resistant material such as metallic member 38 which is mounted to receptacle or holster 32 to block accidental discharge from a gun that has its muzzle disposed within receptacle or holster 32. Member 38 can contour to at least to a portion of sidewall 34 of receptacle or holster 32. Another embodiment includes what was previously discussed as shown in FIG. 9 in which holster 32 is comprised of a ballistic resistant flexible material such as Kevlar® or the like or other common harder materials such as metal, ceramic, etc.

Gun handle holder 64 has gun carrying panel 40 or 44 in FIGS. 7 and 11 respectively, which has been discussed above as contemplating a very wide range of locations on objects where a gun is desired to be secured. Holder 64 includes member 66 for securing about a gun handle. A preferable embodiment includes securing member 66 to a gun handle in which member 66 is an elastic band that is smaller than the outside distance around the gun handle. As a result, the band can be stretched around the outside surface of the gun handle and thereby secure itself to the handle. In addition, pair of releasable universal mating connectors 68 and 70 can typically be a mating pair of hook and loop fasteners or more commonly known as Velcro® and the like. Mounting means 72 such as stitching, as seen in FIGS. 7, 10 and 11, is used to mount one of the pair of releasable universal mating connectors 70 to gun carrying panel 40 and 44. Similarly, stitching is used as the mounting mens along seam 74 as well as other locations on member 66 to secure one of pair of universal mating connectors 68 on member 66. Other conventional mounting means can be used for securing connectors 68 and 70 respectively to member 66 and carrying panels 40 and 44 such as gluing, clipping, clamping, etc., or the like.

When member 66 is secured to a gun handle and releasable universal mating connectors 68 and 70 are engaged, as seen in FIG. 10, the gun is secured to gun carrying panel 40 or 44. Once again panel 40 or 44 can be placed in a number of locations as previously discussed. Because these are universal mating connectors the gun can be placed in any desired, as drawn in phantom for example in FIG. 10, position relative to carrying panel 40 or 44, providing versatility and quick access to the gun and at the same time the gun is prevented from removing itself from adjacent opening 76 of muzzle receptacle 33 as seen in FIGS. 7, 10 and 11, when the wearer is moving about.

Another versatile feature of holder 64 is that member 66 does not have universal mating connectors 68 disposed over the entire surface of member 66. As can be seen in FIGS. 7 and 11, approximately half of member 66 is covered by mating connectors 68. As a result the user can secure member 66 to the gun handle, as seen in FIG. 10, to position the desired amount of mating connector 68 to come into contact with mating connector 70. Should the user need very strong securement, he will place a mating connector 68 into contact with mating connectors 70. On the other hand should a medium or loose hold be desired less connectors 68 and 78 will be mated. Thus, the strength of the hold of the gun handle can be adjustable merely by rotating member 66 about the gun handle to position more or less connectors 68 to releasably connect with connectors 70.

Ballistic resistant garment 10 has a first ballistic resistant panel portion 78 and second ballistic resistant panel portion 80 in which carrying means 82 secures authority identification sign 84 on to second ballistic resistant panel portion 80, as seen in FIGS. 2, 3, 4, 7 and 11. Ballistic resistant garment 10 also includes means for moving 86, facilitated by folding panel 12 or other common means, of second ballistic resistant panel portion 80 in relation to first ballistic resistant panel portion 78 from a nondeployed position as seen in FIG. 5 in which sign 84 is not visible to a deployed position as seen in FIG. 6 in which sign 84 is visible.

Carrying means 82 includes sign 84 stitched with stitches 87 to second ballistic resistant panel portion 80, as seen in FIGS. 4 and 7. Sign 84 is also releasably securable to second ballistic resistant panel portion 80 as shown in FIG. 11 where pair of mating hook and loop fasteners 88 and 90, being Velcro® or the like, in which fastener 88 is secured to second ballistic resistant panel portion 80 and fastener 90 is secured to sign 84. Another carrying means 82 includes gluing letter indicia 92 to second ballistic resistant panel portion 80 as seen in FIGS. 2 and 3 or even painting the same.

As can be seen in FIG. 5 first ballistic resistant panel portion 78 overlies a portion of second ballistic resistant panel portion 80 in its nondeployed position making sign 84 not visible. Means for moving 86 includes hinge or fold 94 which in FIG. 5 is the first and second ballistic resistant panel portions 78 and 80 being integral and comprised of a flexible material through hinge or fold 94, such as Kevlar® or the like.

Ballistic resistant garment assembly 10 includes ballistic resistant panel 12, as seen in FIG. 7, in which mounting means 96 mounts ammunition pouch 98 to ballistic resistant panel 12. Mounting means 96 includes stitching 100 ammunition pouch 98 to ballistic resistant panel 12. Other mounting means 96 can include gluing or even releasable fasteners discussed above, as well as any other common mounting means and the like. Ammunition pouch 98 has an opening 102 for inserting ammunition into pouch 98 and storage of the same. Pouch 98 further includes flap 104 for covering opening 102. Flap 104 is connected to ballistic resistant panel 12 by stitching 106 or by any other conventional manner of securement at one end of flap 104. The other end of flap 104 is connected to ammunition pouch 98 thereby covering opening 102 and preventing ammunition from falling from pouch 98. The other end of flap 104 is typically releasably secured to ammunition pouch 98 by utilizing a pair of mating hook and loop fasteners, Velcro®, or the like 107 and 108. One of the pair of fasteners 106 is secured to flap 104 and the other of the pair of fasteners is secured to ammunition pouch 98. Other commonly known releasable securements such as snaps, buttons and the like can also be used.

Ammunition pouch 98 can be mounted to either the inner side 50 of ballistic resistant panel 12, the side closest to the wearer as seen in FIG. 7, or it can be mounted to the outer side 52 of ballistic resistant panel 12. In addition, for further safety ammunition pouch 98 is formed of a ballistic resistant material of which many common materials are known, such as materials earlier discussed including materials such as Kevlar®, metals and other common ballistic materials and the like.

Ballistic resistant garment 10, as shown in FIG. 11, has first ballistic resistant panel 12 which has mounting means to mount first ballistic resistant panel 12 over at least a portion of a mid-section of a person's body. This mounting means includes member or pouch 16 for carrying panel 12 and belt 45 connected to member or pouch 16 for securing the pouch about a person's body at their mid-section. In addition, panel 12 includes means for suspending first panel 12 from the neck of a wearer which includes strap 26 which is secured to and which forms a loop with first panel 12, as shown in FIG. 11.

Figure 12:
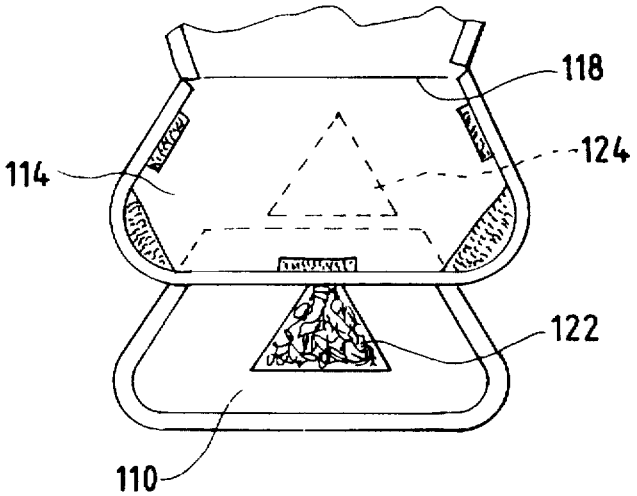
FIG. 12 is a partial perspective view of the pouch assembly having the ballistic resistant crotch pad depending therefrom of FIG. 11.

Ballistic resistant garment 10 further includes second ballistic resistant panel 110 as seen in FIGS. 11 and 12 in which panel 110 is insertable into lower pouch 114 and carried thereby lower pouch 114 is in hinged relationship with pouch 16 at hinge connector or fold 118. Typically, the material for the pouches 114 and 16 are of a durable flexible material such as nylon. Mounting means 112, such as universal hook/loop connectors, or Velcro® or the like, is provided to releasably mount pouch 114 carrying second ballistic resistant panel 110 to pouch 16 carrying first panel 12. When mounting means 112 are secured to mating connector 70 second ballistic resistant panel 110 is in a nondeployed position in which lower pouch 114 and panel 110 are in overlying relationship to pouch 16 and panel 12. When desired pouch 114 carrying panel 110 is released from pouch 16 and deployed along hinge connector or fold 118. Thus, when pouch 16 and lower pouch 114 are in releasable securement and thereby first and second ballistic panels 12 and 110 are in overlying relationship and panel 110 is nondeployed. However, should the wearer desire deployment the wearer simply pulls on lower pouch 114 disengaging mounting means 112, which are a pair of mating hook and loop fasteners in which one of said pair is mounted on pouch 16 which carries first panel 12 and the other of the pair is mounted to lower pouch 114 which carries second ballistic resistant panel 110. Lower pouch 114 deploys as the position seen in FIG. 11 thereby extending second ballistic resistant panel 110 below first panel 12 resulting in covering the wearer's lower torso and crotch area with second ballistic panel 110.

Further, first ballistic resistant panel 12 is releasably secured to an inner portion of pouch 16 by having typically mating pairs of hook and loop fasteners 119 and 120, respectively secured to panel 12 and pouch 16, comprising Velcro® or other common releasable securement fasteners, as shown in FIG. 11. Likewise, second ballistic resistant panel 110 is releasably secured to an inner portion of lower pouch 114 by utilizing releasable securement fasteners 122 and 124 which likewise include mating pair of hook and loop fasteners, such as Velcro® or the like. Fastener 122 is secured to second ballistic resistant panel 110 and fastener 124 is secured to an inner portion of lower pouch 114, as seen in FIG. 12.

Ballistic resistant garment 10 includes foldable ballistic resistant panel 12 as shown in FIG. 5 having bottom portion 78 and top portion 80 which is movable from a folded position to an extended position as seen in FIG. 6. Garment 10 further includes means for grasping 24 and deploying ballistic resistant panel 12 from a folded position to an extended position which is attached to the top portion of panel 12. Grasping and deploying means 24 includes strap 26 which forms a loop with the top portion of ballistic resistant panel 12. Strap 26 in forming the loop has each of its ends stitched with stitching 128 to the top portion of panel 12. Strap 26 is elastic to provide stretchability to give a user variability in making the loop larger if necessary to pull over his or her head.

In addition, releasably securing means 130 are provided in FIG. 7, for releasably securing a portion of strap 26 to a top portion of panel of panel 12. Releasably securing means 130 are a pair of mating hook and loop fasteners such as Velcro® or the like in which one of the pair 132 is secured to strap 26 and the other of the pair 134 is secured to the top portion of panel 12. This structure provides reducing the size of the loop formed by strap 26 so as to make it more compact when panel 12 is in a folded position in pouch 16 and yet provide easy grasping of strap 26.

Ballistic resistant garment 10 has ballistic resistant panel 12 and means for suspending 136 for suspending panel 12 from the neck of a wearer as seen in FIGS. 2 and 3. Panel 12 as discussed previously has a bottom and top portions 78 and 80 in which suspending means 136 is secured to top portion 80. Suspending means 136 includes strap member 26 secured to ballistic resistant panel 12 to form a loop with panel 12 in order to receive a wearer's neck from which panel 12 can suspend. Strap member 26 has both of its ends secured with stitching 128 as seen in FIG. 11 to ballistic resistant panel 12. Additionally, strap member is preferably elastic providing versatility in expanding the loop to place over a wearer's head and around their neck. As described previously, releasably securing means 130 are provided to secure a portion of strap 26 to a top portion of panel 12, as shown in FIG. 11. Releasable securing means 130 includes one of a pair 132 of mating hook and loop fasteners such as Velcro® or the like secured to the strap 26 and the other of the pair 134 is secured to top portion of panel 12. This provides the ability to make the loop more compact when panel 12 is not deployed and still keep strap 26 easily grasped for deployment of panel 12.

Pouch carrying assembly 16 as shown in FIG. 7, having inside panel 138 which is adjacent to a wearer's body and outer panel 140. Both panels 138 and 140 are adjacent to opening 142. Inner belt section 144 is stretchable from a first length A to a second length B which is longer than the first. Outer belt 146 is of the second length B. Means for securing 148 the right ends of each the inner and outer belt sections 144 and 146 together and the left ends together which includes stitching 150 such ends, as seen in FIG. 7. Also, means 152 for securing inner belt section 144 to inside panel 138 adjacent to pouch opening 142 are provided. Means 154 for securing outer belt section 146 to outside panel 140 adjacent pouch opening 142 which preferably includes stitching or the like. Securing means 152 for inner belt section 144 includes means for permitting 156 at least a portion of inside panel 138 secured to inner belt section 144 to extend from first length A to second length B thereby closing opening 142. Permitting means 156 preferably includes pleats which are formed by gathering the less elastic material of pouch 16 and securing the pleats with stitching 160. Thus, when inner belt section 144 is pulled about the wearer's body and being elastic it stretches and pleats 150 permit the stretching of inner belt section 144 permitting stretching of inner belt section 144 to approximately length B reducing opening 142.

Inner belt section 144 is elastic and is shorter than outer belt section 146 thus when the wearer places pouch 16 to his body and secures it to the same he will stretch inner belt section 144.

Figure 8:
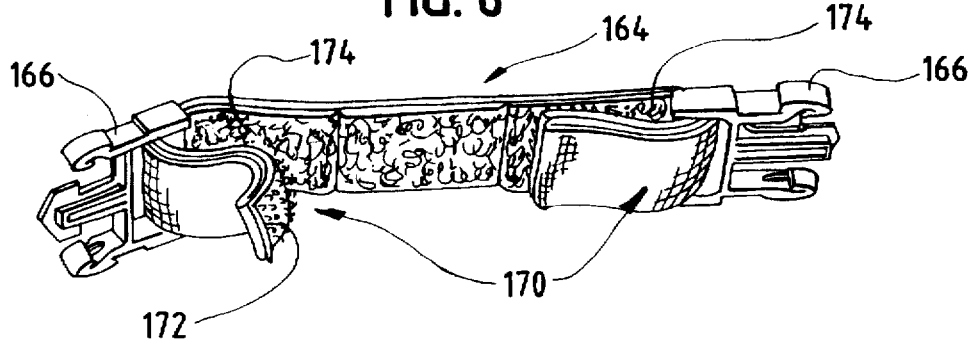
FIG. 8 is a perspective view of a belt section of the ballistic resistant garment assembly.

Outer belt section 146 is stitched 154 to outer panel 140 which would inhibit outer belt section 146 from stretching. Another belt member 164 will complete the securement of pouch 16 to the wearer and is securable to opposite ends of inner and outer belt sections 144 and 146. The securement to complete a belt structure about the wearer is providing releasable mating connectors 166 and 168, seen in FIGS. 7 and 8. Another belt member 164 has means for adjusting the length of itself 170. Adjusting means 170 includes at least one end of another belt member 164 which can be pulled around a portion of connector 166, as seen in FIG. 8, and folded over itself to shorten the length of another belt member 164. The end portion of another belt member 164 carries one of a pair 172 of mating hook and loop fasteners, such as Velcro® and the like, that can releasably connect a portion of another belt member 164 that the end portion overlies which carries the other of the pair 174 of mating hook and loop fasteners. Adjusting means 170 also includes another belt member 164 being made of a flexible material and being elastic to make secure and comfortable mountings of pouch 16 to varying wearer body sizes.

A method of deploying ballistic resistant panel 12 carried by garment pouch 16 by moving ballistic resistant panel 12 from pouch 16 to an extended position outside pouch 16 can be seen in FIGS. 1–3 and 5 and 6. This method comprises the steps of grasping ballistic resistant panel 12 from garment pouch 16 and lifting ballistic resistant panel 12 to the extended position. This method includes pulling strap 26 or 28 that is connected to the top portion of ballistic resistant panel 12 which will result in deploying panel 12 from pouch 16. Strap 26 or 28 has both of its ends connected to the top portion of ballistic resistant panel 12. The method includes pulling strap 26 over the head of the user suspending the strap from the wearer's neck as seen in FIGS. 2 and 3.

When the wearer is completed with use of ballistic resistant panel 12, the method includes removing strap 26 from about the neck of the wearer.

Ballistic resistant panel 12 is releasably connected to pouch 16 which keeps panel 12 secured to pouch 16 when the wearer deploys the vest and the wearer has secured pouch 16 to his body, typically being inner and outer belt sections 144 and 146 and another belt member 164, as seen in FIG. 7. Panel 12 can be connected to any portion of pouch 16 however it would be more desirable to connect panel 12 to an inner portion of pouch 16, as shown in FIG. 11. A desirable way of releasably connecting panel 12 to pouch 16 is to utilize one of a pair 118 of mating hook and loop fastener member and the other of a pair 120 of mating hook and loop fastener member securing the former to panel 12 and the latter to an inner portion of pouch 16 as shown in FIG. 11.

A new method for adjusting and securing gun holster 32 having muzzle receptacle or holster 32 to receptacle carrying panel 44 as shown in FIG. 11, provides securing universal mating connector, such as Velcro® and the like, 58 to receptacle carrying panel 44 and securing universal mating connector 60, such as Velcro® and the like, to a side of muzzle receptacle or holster 32, these steps are interchangeable. Finally, the step of releasably securing universal mating connectors 58 and 60 of muzzle connector 33 to receptacle carrying panel 44. As described earlier receptacle carrying panel 44 can include a wide variety of locations on a variety of objects.

This method also includes the steps of releasing universal mating connectors 58 and 60 of carrying panel 44 and receptacle 33 thereby releasing gun holster 32 from a first position on carrying panel 44 and releasably securing connectors 58 and 60 of carrying panel 44 and receptacle or holster 32 to a second position on receptacle carrying panel 44. Universal mating connectors 58 and 60 include one of a pair of mating hook and loop fasteners, such as Velcro® and the like, secured to receptacle carrying panel 44 and the other of the pair secured to a side receptacle or holster 32. Further, as described earlier muzzle receptacle or holster 32 can be constructed to block accidental discharges that are in alignment with receptacle or holster 32 and be formed of a ballistic resistant material such as Kevlar® as shown in FIGS. 7, 13 and 14 or other common ballistic resistant materials.

A new method for attaching and displaying authority identification sign 84 to a ballistic resistant garment having first and second ballistic resistant panel portions 78 and 80, as seen for example in FIG. 11. Sign 84 is preferably carried by second panel portion 80 and in which first ballistic resistant panel portion 78 is mounted in relation to second panel portion 80 for movement between a nondeployed position in which sign 84 is not visible, as shown in FIG. 5, and a deployed position in which sign 84 is visible. This method comprises the steps of placing first and second ballistic resistant panel portions 78 and 80 in a nondeployed position, as seen in FIG. 5, and moving first and second panel portions into a deployed position displaying sign 84, as seen in FIG. 4, it may be noted that this method could as well include sign 84 being carried on first panel portion 78. This method includes stitching 86 sign 87 to second panel portion 80, as seen in FIG. 4. Further another step includes adhering letter indicia 92 as seen in FIGS. 2 and 3 to second panel portion 80 with glue or similar adhesives or the like or painting thereon. Securement of sign 84 includes another step of releasably securing sign 84 to ballistic resistant panel portion 80, as shown in FIG. 11. This is accomplished by utilizing one of a pair 88 of mating hook and loop fasteners secured to a second ballistic resistant panel portion 80 and the other of the pair 90 secured to sign 84.

This method also includes the steps of folding first ballistic resistant panel portion 78 over second ballistic resistant panel portion 80 such that first panel portion 78 overlies sign 84 in the nondeployed position as shown in FIG. 5.

A new method for adjustably securing gun handle, as seen in FIG. 10, to a gun carrying panel 40, which is discussed previously contemplates a wide variety of locations on a wide variety of objects, including garments, ballistic resistant garments and all types of objects where a gun could be located. This method has member 66 carried by the gun handle in which each of a pair of releasable universal mating connectors 68 and 70 are mounted to member 66 and panel 40 respectively. The steps include securing member 66 to the gun handle and the step of releasably securing releasable mating pair of connector 68 and 70 to one another securing to the gun handle to panel 40 in the desired position. This method also includes the steps of disengaging pair of releasable universal mating connectors 68 and 70 and removing the gun from a first position, as shown in phantom in FIG. 10, and engaging pair of connectors 68 and 70 positioning the gun in a second position on gun carrying panel 40, as also seen in FIG. 10.

Further, the universal mating connectors cover a portion of the member, thus, the method includes the step of adjusting the member to gun handle to orient the connectors mounted on the member to vary the amount of connectors at said portion that engage the universal mating connectors mounted to the carrying panel to obtain the desired strength of connection between the gun handle and the carrying panel.

While a detailed description of the preferred embodiment of the invention has been given, it should be appreciated that many variations can be made thereto without departing from the scope of the invention set forth in the appended claims.

We claim:

1. A bullet resistant garment carrying assembly, comprising:

a foldable bullet resistant panel capable of stopping a bullet fired from a firearm in which the panel in a deployed position overlies at least a portion of the torso of a wearer, in which the panel has a top portion at the chest of the torso and a bottom portion at the waist of the torso, in which a central portion positioned therebetween is narrower in width in a transverse direction to the direction in which the torso extends and than the width in said transverse direction of the top portion and bottom portion of the panel;

a pouch member to carry the bullet resistant panel in a folded nondeployed position whereby the bottom portion of said bullet resistant panel is releasably connected to an inner portion of the pouch by a pair of mating hook and loop fasteners in which one pair of the pair is attached to the panel and the other of said pair is attached to the inner portion of the pouch;

means for securing the pouch to a body of a wearer; and means for moving the panel from said nondeployed position to a deployed position.

2. The bullet resistant garment assembly of claim 1 in which the top portion of the bullet resistant panel is positioned at an opening in said pouch and is unsecured to the pouch at the top portion with the panel in said nondeployed position.

3. The bullet resistant garment carrying assembly of claim 1 in which the securing means includes a garment secured to the pouch.

4. The bullet resistant garment carrying assembly of claim 3 in which the garment is a belt.

5. The bullet resistant garment assembly of claim 1 in which the moving means includes a strap connected to the top portion of said bullet resistant panel.

6. A bullet resistant garment comprising:

a first bullet resistant panel capable of stopping a bullet fired from a firearm;

a second bullet resistant panel capable of stopping a bullet fired from a firearm; and means for mounting the second panel to the first panel for movement between a nondeployed position in which the first panel is in a compact position and the second panel is in overlying relationship with said first panel, to a deployed position in which the first panel extends upwardly over the torso of a wearer and the second panel extends below the first panel in which said mounting means includes means for securing said first and second panels to the waist area of the wearer including a pouch member for carrying said first bullet resistant panel in a compact position and having means to secure the pouch member about the waist of the wearer and to position the pouch member across the anterior portion of the waist of the wearer, and means for releasably securing the first and second panels in overlying relationship to one another in which the second panel is movable from said overlying relationship to a downward direction from the waist area of the wearer to an overlying position over a crotch area of the wearer including a pouch panel member for carrying said second panel member and in which said pouch panel member is hingedly connected to said pouch member and another portion of said pouch panel member releasably secured to the pouch member in said nondeployed position with said pouch panel member secured to said pouch member and said pouch panel member moveable in relationship to the pouch member to a position in which said second panel member extends below said first panel member to overlie said crotch region of the wearer with the other portion of the pouch panel unsecured from said pouch member.

7. The bullet resistant garment of claim 6 in which the mounting means for the first panel includes a means for suspending the first panel from around the neck of a wearer in which the first panel extends over said torso of the wearer.

8. The bullet resistant garment of claim 7 in which the suspending means includes a loop secured to the first panel.

9. The bullet resistant garment of claim 6 in which said hinged connector includes flexible material disposed between the pouch member and the pouch panel member.

10. The bullet resistant garment of claim 6 in which the pouch panel member forms a pocket to contain the second panel member.

11. The bullet resistant garment of claim 10 in which the second panel is releasably secured to an inside portion or said pocket.

12. The bullet resistant garment of claim 6 in which said releasable securing means for releasably securing the first and second panels in overlying relationship to one another includes a pair of mating hook and loop fasteners in which one of the pair of fasteners is secured to the pouch member and the other of the pair of fasteners is secured to the pouch panel member which carries said second panel.

13. A bullet resistant garment comprising:

a foldable bullet resistant panel capable of stopping a bullet fired from a firearm having a bottom portion positioned within a pouch member in which the pouch member includes means for securing the pouch member about the waist of a wearer and a top portion of said panel which is moveable from a folded position with said bottom portion within said pouch member in which an upper portion of the top portion of the panel is positioned at an opening in said pouch member with said top and bottom portions in said folded position to an extended position in which said top portion is unfolded with said bottom portion and positioned to overlie a least a portion of the torso of the wearer; and a strap having its two ends each stitched to the upper portion of said top portion of the bullet resistant panel which extends upwardly from said upper portion and positioned adjacent said opening of the pouch member with the top portion of said panel in said folded position with the bottom portion of said panel for grasping and deploying the top portion of the panel from said folded position within said pouch to the extended position.

14. The bullet resistant garment of claim 13 in which said strap forms a loop with the upper portion of said top portion of the bullet resistant panel.

15. A bullet resistant garment comprising:

a bullet resistant panel having a top and a bottom portion for overlying the torso of a wearer in a deployed position, in which the panel is held in a nondeployed position within a pouch member secured about the waist of the wearer and in which an upper end of said top portion of the panel is unsecured to the pouch member and is positioned at an opening of the pouch member through which the top portion of the panel is deployed to overlie said torso; and a strap secured at opposing ends of said strap to the top portion of the panel to form a loop with the top portion of the panel to suspend the panel from a neck of the wearer with the panel in a deployed position and in which the strap is positioned at the opening of the pouch with the panel in said nondeployed position in which a portion of the strap positioned between the opposing ends is releasably secured to the top portion of the panel to form at least one more smaller loop with the top portion of the panel at said upper end.

16. The bullet resistant garment of claim 15 in which the strap member is elastic.

17. The bullet resistant garment of claim 15 includes one of a pair of mating hook and loop fasteners secured to the strap and the other of the pair of fasteners secured to a top portion of the panel to releasably secure a portion of the strap positioned between opposing ends to the top portion of the panel.

18. A method of deploying a bullet resistant panel over at least a portion of a torso of a wearer, comprising the steps of:

providing said panel capable of stopping a bullet shot from a firearm having a top and bottom portion folded within and carried by a garment pouch in which the top portion has an upper end which is positioned at an opening in said pouch and in which said upper end is unsecured to the pouch;

grasping said upper unsecured end of the top portion of the bullet resistant panel positioned at said opening in the pouch from the garment pouch including grasping a strap connected to the top portion of the bullet resistant panel and positioned at the opening of the pouch with the top and bottom portions folded within the pouch; and lifting the top portion of said bullet resistant panel to overlie said at least a portion of said torso of said wearer.

19. The method of deploying a bullet resistant panel of claim 18 in which the step of grasping a strap includes the strap having two ends each connected to said panel.

20. The method of deploying a bullet resistant panel of claim 19 including the steps of:

pulling the strap over a head of a wearer, and suspending the strap from the neck of the wearer.

21. The method of deploying a bullet resistant panel of claim 20 including the step of:

removing the strap from about the neck of the wearer.

22. The method of deploying a bullet resistant panel of claim 18 including the step of:

connecting a portion of the bullet resistant panel to the pouch.

23. The method of deploying a bullet resistant panel of claim 22 in which the step of providing the panel includes the bullet resistant panel being releasably connected to the pouch.

24. The method of deploying a bullet resistant panel of claim 22 in which the step of providing the panel includes the bullet resistant panel is connected to an inner portion of the pouch.

25. The method of deployment of a bullet resistant panel of claim 18 including the step of securing the pouch to the body of a wearer.

* * * * *

UNITED STATES PATENT AND TRADEMARK OFFICE
CERTIFICATE OF CORRECTION

PATENT NO : 5,797,140

DATED : August 25, 1998

INVENTOR(S) : Richard Clinton Davis, et al.

It is certified that error appears in the above-identified patent and that said Letters Patent is hereby corrected as shown below:

Col. 7, Line 65, -- Start a new paragraph with "In the deployed position" --.

Col. 10, Line 12, Change "mens" to -- means --.

Col. 14, Line 62, Change ", it" to -- . It --.

Signed and Sealed this

Seventeenth Day of August, 1999

*Attest:*

*Attesting Officer*

Q. TODD DICKINSON

*Acting Commissioner of Patents and Trademarks*